US006779795B1

(12) United States Patent
Le

(10) Patent No.: US 6,779,795 B1
(45) Date of Patent: Aug. 24, 2004

(54) METHOD OF PLAYING A WAGERING GAME

(76) Inventor: Johnny P. Le, 121 Chateau La Salle Dr., San Jose, CA (US) 95111

( * ) Notice: Subject to any disclaimer, the term of this patent is extended or adjusted under 35 U.S.C. 154(b) by 0 days.

(21) Appl. No.: 10/454,961

(22) Filed: Jun. 5, 2003

Related U.S. Application Data

(63) Continuation-in-part of application No. 10/217,085, filed on Aug. 12, 2002, now abandoned.

(51) Int. Cl.[7] ..... A63F 1/00
(52) U.S. Cl. ..... 273/292; 273/274
(58) Field of Search ..... 273/292, 274, 273/309; 463/12, 13

(56) References Cited

U.S. PATENT DOCUMENTS 4,659,087 A * 4/1987 Shen et al. ..... 273/274
5,072,946 A * 12/1991 Miller ..... 273/292
5,690,337 A * 11/1997 Somma et al. ..... 273/309
6,474,646 B1 * 11/2002 Webb ..... 273/274

OTHER PUBLICATIONS

"9's Up", Harrah's Lake Tahoe Resort Casino, 1988.*
"Blackjack Jokers", Normandie Casino and Showroom, 1994.*

* cited by examiner

*Primary Examiner*—Benjamin Layno
(74) *Attorney, Agent, or Firm*—Ted Masters

(57) ABSTRACT

A method of playing a wagering game includes providing a modified deck of playing cards from which all of the picture cards have been removed. Each player places a wager and is dealt four cards which are set into a two card front hand and a two card back hand. A player/banker sequentially compares both front hands and back hands with each player. The ranking of hands is (1) highest pair, and (2) LSD of the numerical total of the two cards being closest to nine. Several special sequentially applied rules result in the player/banker or the other player winning the wager regardless of the ranking of the two card front and back hands.

1 Claim, 4 Drawing Sheets

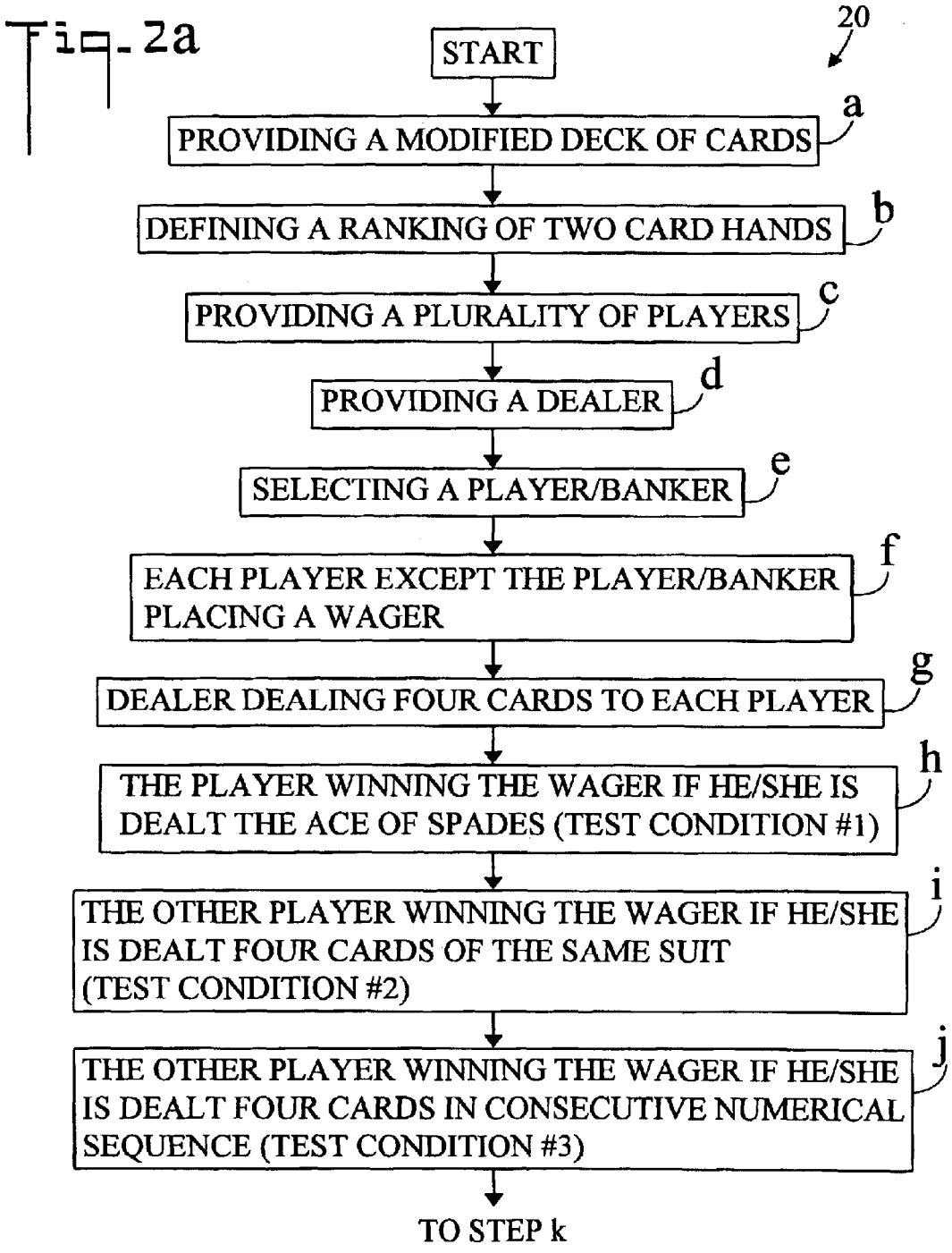
Fig. 2a
20
START
PROVIDING A MODIFIED DECK OF CARDS
a
DEFINING A RANKING OF TWO CARD HANDS
b
PROVIDING A PLURALITY OF PLAYERS
c
PROVIDING A DEALER
d
SELECTING A PLAYER/BANKER
e
EACH PLAYER EXCEPT THE PLAYER/BANKER PLACING A WAGER
f
DEALER DEALING FOUR CARDS TO EACH PLAYER
g
THE PLAYER WINNING THE WAGER IF HE/SHE IS DEALT THE ACE OF SPADES (TEST CONDITION #1)
h
THE OTHER PLAYER WINNING THE WAGER IF HE/SHE IS DEALT FOUR CARDS OF THE SAME SUIT (TEST CONDITION #2)
i
THE OTHER PLAYER WINNING THE WAGER IF HE/SHE IS DEALT FOUR CARDS IN CONSECUTIVE NUMERICAL SEQUENCE (TEST CONDITION #3)
j
TO STEP k

METHOD OF PLAYING A WAGERING GAME

CROSS REFERENCE TO RELATED APPLICATION

This application is a Continuation in Part of application Ser. No. 10/217,085, filed Aug. 12, 2002 now abandoned.

TECHNICAL FIELD

The present invention pertains generally to wagering games, and more particularly to a method of playing a wagering game wherein a player places a wager, receives four cards, and sets the four cards into a two card front hand and a two card back hand.

BACKGROUND OF THE INVENTION

Pai gow poker is a variation of the Chinese domino game gai gow and is well known in the art. Pai gow poker is usually played with a 53 card deck, including a joker. The game is played between a player(s) and a player-banker, each competing to make the best possible hands. Each player makes a wager and is then dealt seven cards. The cards are then set by the player into a two card front hand and a five card back hand. Both the front and back hands are compared to determine the winner.

Sources well known in the art of Pai Gow Poker include Mason Malmuth, "The Gambling Theory and Other Topics" (Las Vegas: Mason Malmuth, © 1990); Bill Zender, "Pai Gow Poker (Las Vegas: Bill Zender, ©1991); Stanford Wong, "Optimal Strategy for Pai Gow Poker" (La Jolla: Pi Yee Press ©1992); George Allen, "How to Play Pai Gow Poker (Tempe: George Allen, ©1988); and Mike Caro, "Caro's Professional Pai Gow Poker Report and Banker Guidelines (Las Vegas: Mike Caro, © 1986). The present invention has certain features which are similar to Pai gow poker.

The game of 9's UP also contains features which are similar to the present invention. In this game, a player is dealt four cards which are set into a two card front hand and a two card back hand. The two hands are arranged as highly as possible with the higher ranking hand being the back hand. Pairs are ranked highest followed by a hand in which the sum of the two cards is closest to nine. To win a wager both the front and back hands of a player must rank higher than the banker.

SUMMARY OF THE INVENTION

The present invention is directed to a method of playing a wagering game using a modified deck of conventional playing cards from which all the face cards have been removed. After placing a wager, each player is dealt four cards which are set into a two card front hand and a two card back hand. Players then sequentially compare hands with a player/banker. The ranking of hands is (1) highest pair, and (2) the least significant digit (LSD) of the numerical total of the two cards being closest to nine. To determine who wins the wager, a set of test conditions are sequentially applied. If the first test condition is satisfied, then the wager is decided. If the first test condition is not satisfied, then a second test condition is applied. If the test second condition is satisfied, then the wager is decided. If the second test condition is not satisfied, then a third test condition is applied [for ], etc. The sequence of applying the test condition is important, so certain steps (test conditions) of the present method must be performed in the order indicated.

Preferred names for game of the present invention are "Buu-Buu " (pair-pair) and Paigow 9.

The method of the present invention includes a variety of ways to win a wager, wherein the determination of a winning hand must be evaluated according to a sequentially applied set of criteria (test conditions). As such, the present invention presents a mental challenge to the players which is not present in other card games.

In accordance with a preferred embodiment of the invention, a method of playing a wagering game includes the steps of:

(a) providing a modified deck of playing cards which includes a conventional deck of playing cards from which all face cards have been removed;

(b) defining a ranking of two card hands, wherein pairs are ranked highest followed by hands which sum closest to nine;

(c) providing a plurality of players;

(d) providing a dealer;

(e) selecting a player/banker from the plurality of players, the unselected players being termed other players;

(f) each of other players (other than the player/banker) placing a wager;

(g) the dealer dealing four cards from the modified deck to each of the players;

(h) the player winning the wager if one of the four cards dealt to the player is the ace of spades (Test Condition #1), else proceeding to step (i);

(i) the other player winning the wager if the four cards dealt to the other player are all of the same suit (Test Condition #2), else proceeding to step (j);

(j) the other player winning the wager if the four cards dealt to the other player are in consecutive numerical sequence (Test Condition #3), else proceeding to step (k);

(k) each player setting his/her four cards into a two card front hand and a two card back hand;

(l) the player/banker sequentially comparing both front and back hands with each other player;

(m) the other player winning the wager if the back hand of the other player is identical to the back hand of the player/banker (Test Condition #4), else proceeding to step (n);

(n) the player/banker winning the wager if the front hand of the other player is identical to the front hand of the player/banker (Test Condition #5), else proceeding to step (o);

(o) the player/banker winning the wager if (1) the front hand of both the other player and the player/banker have a least significant digit of a numerical total equaling zero, or if (2) the back hand of both the other player and the player/banker have a least significant digit of a numerical total equaling zero (Test Condition #6), else proceeding to step (p);

(p) the other player winning the wager if the front hand of the other player ranks higher than the front hand of the player/banker and the back hand of the other player ranks higher than the back hand of the player/banker (Test Condition #7), else proceeding to step (q);

(q) the player/banker winning the wager if the front hand of the player/banker ranks higher than the front hand of the other player and the back hand of the player/banker ranks higher than the back hand of the other player (Test Condition #8), else proceeding to step (r);

(r) neither the other player nor the player/banker winning the wager if none of Test Conditions 1–8 above are satisfied;

(s) if in step (g) the other player is dealt four of a kind, the other player winning a jackpot; and, (t) wherein steps (h) through (r) above must be performed in the alphabetical order indicated.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
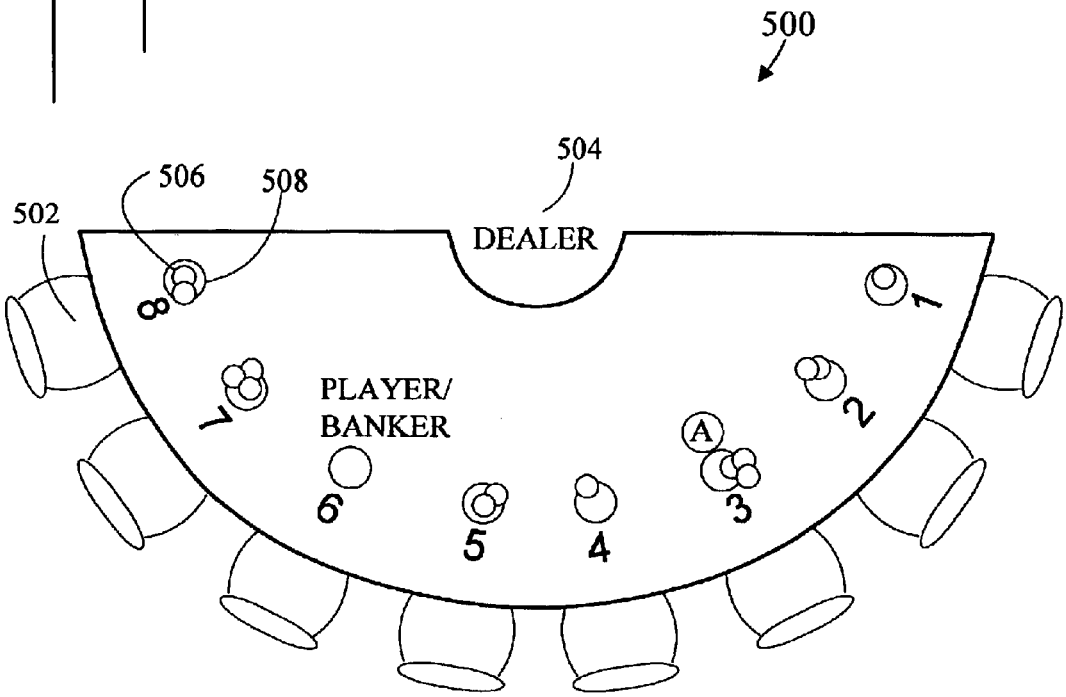
FIG. 1 is a plan view of a playing layout of the present invention, and, FIGS. 2*a*–2*c* is a flow diagram of the method of the present invention.

Referring initially to FIG. 1, there is illustrated a playing layout of a wagering game in accordance with the present invention, generally designated as 500. The playing layout 500 includes a plurality of player positions 502 (eight in the shown embodiment) and a dealer position 504, and is especially suited for play at a casino or other gaming establishment. In the shown embodiment, the dealer is a non-participating house dealer. The players place wagers 506 in betting areas 508 directly in front of them on playing layout 500. One of the players is selected as player/banker (position 6), wherein the player/banker plays against each of the other players. In one embodiment of the invention an action player A (position 3) is selected wherein the action player is the first to play against the player/banker.

Figure 2B:
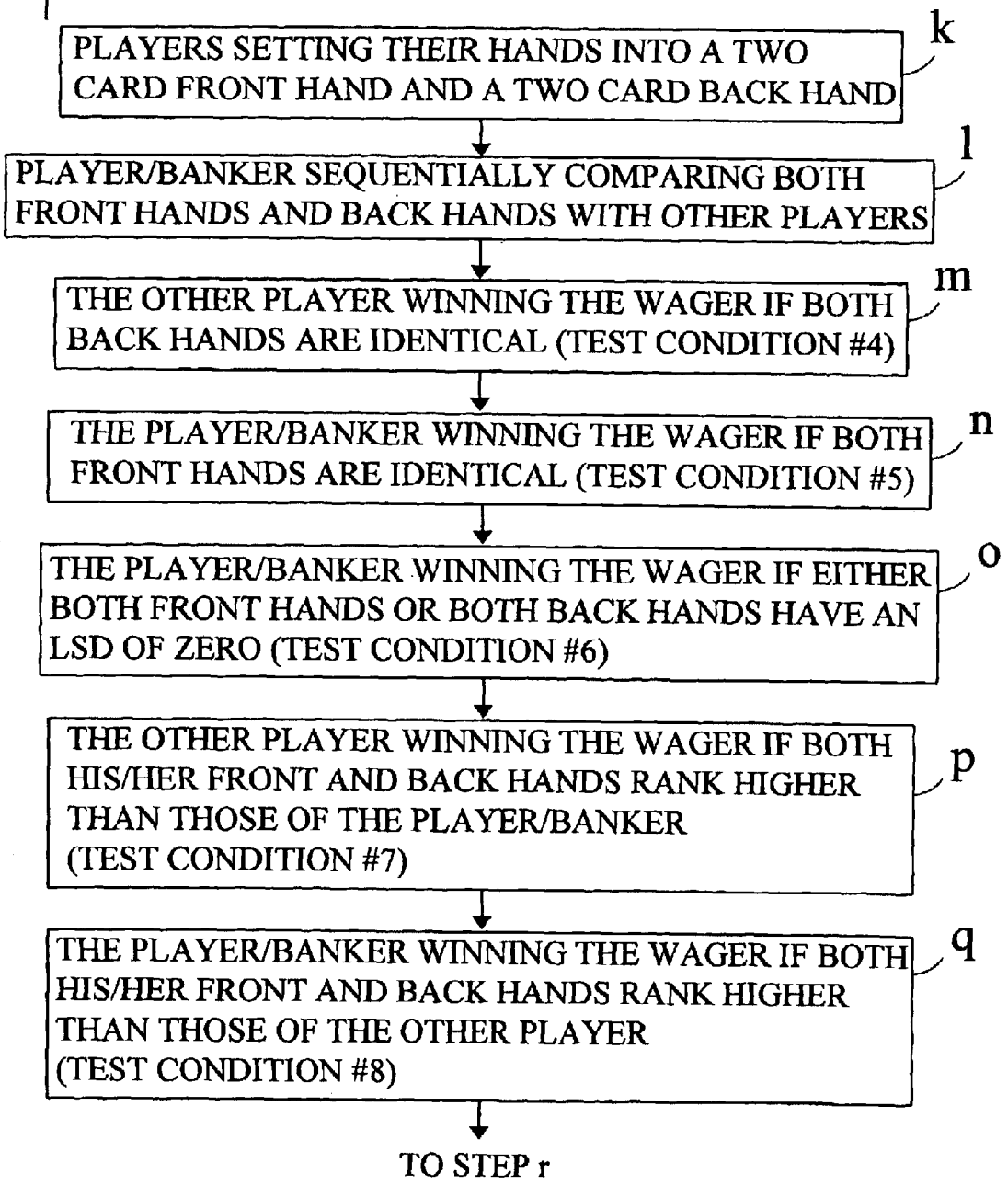
Figure 2C:
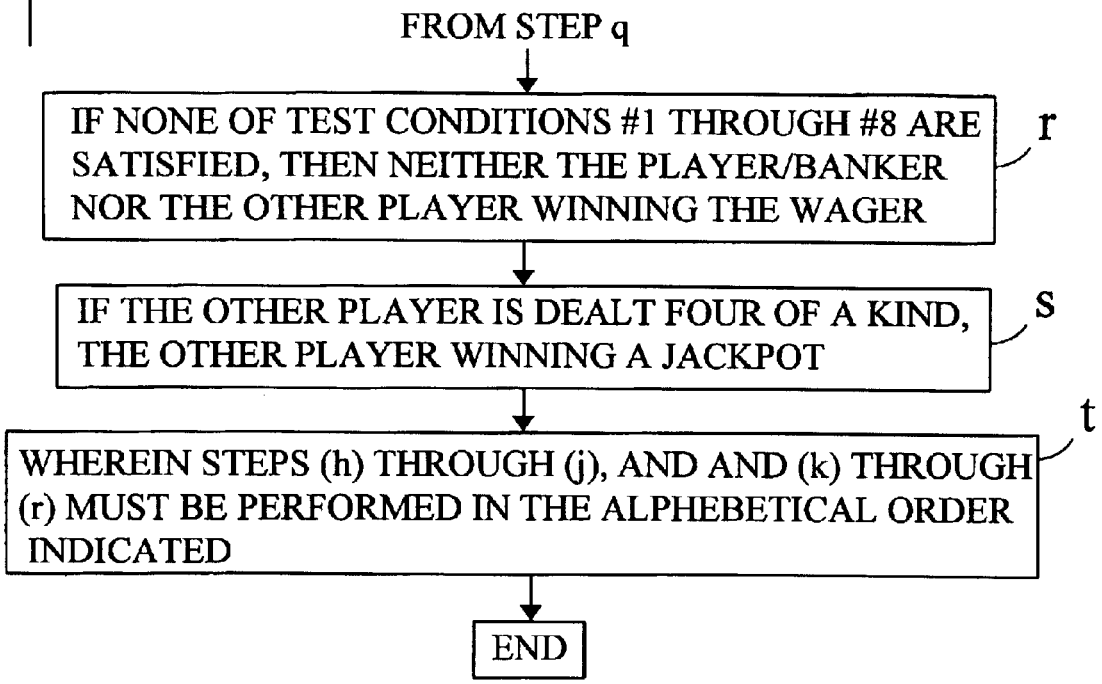

Now referring to FIG. 2, there is illustrated a method of playing a wagering game in accordance with the present invention, generally designated as 20. A round of play commences with START. In step (a) a modified deck of playing cards is provided. The modified deck of playing cards includes a conventional deck of 52 playing cards from which all face cards (Jacks, Queens, and Kings) have been removed to result in a 40 card deck In step (b) a ranking of two card hands is defined. From highest to lowest the ranking is:

a pair of aces;

a pair of tens;

a pair of nines;

a pair of eights;

a pair of sevens;

a pair of sixes;

a pair of fives;

a pair of fours;

a pair of threes;

a pair of twos;

a least significant digit of a numerical total of two cards equaling nine;

a least significant digit of a numerical total of two cards equaling eight;

a least significant digit of a numerical total of two cards equaling seven;

a least significant digit of a numerical total of two cards equaling six;

a least significant digit of a numerical total of two cards equaling five;

a least significant digit of a numerical total of two cards equaling four;

a least significant digit of a numerical total of two cards equaling three;

a least significant digit of a numerical total of two cards equaling two;

a least significant digit of a numerical total of two cards equaling one; and, a least significant digit of a numerical total of two cards equaling zero;

The least significant digit (LSD) is the right most digit of the numerical total of two cards. For example, an eight and a ace would have a numerical total of 9 with an LSD of 9. In the present invention aces have a numerical value of 1. A ten and an eight have a numerical total of 18, wherein the LSD is eight. Similarly, a nine and a five have a numerical total of 14, wherein the LSD is four.

In step (c) a plurality of players are provided. As will be seen in step (e) below, the plurality of players includes a player/banker and at least one other player who plays against the player/banker.

In step (d), a dealer is provided. The present invention can be played as a "California" game using a non-participating house dealer, or alternatively can have one of the players serve as dealer. In another embodiment, one of the players can be a participating house dealer. The house dealer both deals the cards and participates in the game, including periodically assuming the role of player/banker.

In step (e), a player/banker is selected. The player/banker plays against each of the other players (players who are not the player/banker). In an embodiment of the invention, the role of player/banker periodically rotates amongst all the players. In another embodiment of the present invention the dealer and the player/banker are one in the same.

In step (f), each of the other players (not the player/banker) places a wager.

In step (g), the dealer deals four cards from the modified deck to each of the players. In an embodiment of the invention, prior to step (g) an action player is selected. The selection of the action player is random such as by using dice. In another embodiment of the invention, prior to step (g), the player/banker makes a wager which defines a bank. During a round of play, the player/banker can lose no more money than is in the bank.

In step (h), the player (player/banker or other player) wins the wager of step (f) if one of the four cards dealt to the player is the ace of spades. That is, if any player (including the player/banker) is dealt the ace of spades, that player automatically wins the wager. For example if the dealt cards are:

Other player: 4, 2, 7, A (of spades)

Player/banker: 5, 5, 8, 7

The other player would win the wager since he/she was dealt the ace of spades. It is noted that if the other player holding the ace of spades is not the first player to compare hands with the player/banker, the other player could either (l) immediately expose the winning ace of spades, or (2) wait until it is his/her turn to expose the ace of spades (refer to step (l) below).

In step (i), the other player wins the wager of step (f) if the four cards dealt to the other player are all of the same suit, else proceeding to step (j). That is, if the four cards dealt to any of the other players are all spades, all hearts, all diamonds, or all clubs, the other player wins the wager. For example if the dealt cards were:

Other player: 4 (clubs), 2 (clubs), 7 (clubs), A (clubs)

Player/banker: 5, 5, 6, 6

The other player would win the wager since he/she was dealt four clubs. It is noted that if the other player holding four cards of the same suit is not the first player to compare hands with the player/banker, the other player could either (1) immediately expose the four cards of the same suit, or (2) wait until it is his/her turn to expose the four cards of the same suit (refer to step (l) below).

In step (j), the other player wins the wager of step (f) if the four cards dealt to the other player are in consecutive numerical sequence, else proceeding to step (k). That is, if the four cards dealt to any of the other players are in consecutive order (that is form a four card straight), other player wins the wager. For example if the dealt cards were:

Other player: 4, 6, 3, 5

Player/banker: 5, 5, 6, 6

The other player would win the wager since he/she was dealt four cards in consecutive numerical sequence (3, 4, 5, 6). As defined herein, the lowest consecutive numerical sequence is 2, 3, 4, 5, and the highest consecutive numerical sequence is 8, 9, 10, ace. The sequence cannot extend around the ace/2 boundary. That is, 10, ace, 2, 3 is not a consecutive numerical sequence. It is noted that if the other player holding the four cards in consecutive numerical sequence is not the first player to compare hands with the player/banker, the other player could either (1) immediately expose the four cards in consecutive numerical sequence, or (2) wait until it is his/her turn to expose the four cards in consecutive numerical sequence (refer to step (l) below).

In step (k), each of the players sets his/her four cards into a two card front hand and a two card back hand. In an embodiment of the invention, during the setting process the front hand should not rank higher than the back hand.

In step (l) the player/banker sequentially compares both front and back hands with each of the other players. That is, starting with the action player, the player/banker in turn compares front and back hands with each other player. The comparison process with each other player is described in steps (m) through (q) below.

In step (m) the other player wins the wager of step (f) if the back hand of the other player is identical to (a "copy" of) the back hand of the player/banker, else proceeding to step (n). As defined herein, "identical" means that the two card back hands of the other player and the player/banker contain the same cards but of different suits (e.g. the ace of diamonds and five of clubs would be identical to the ace of hearts and five of spades). For example if the dealt and set cards were:

Other player: 3, 4, 3, 5→4, 5 front hand and 3, 3 back hand

Player/banker: 3, 10, 2, 3→10, 2 front hand and 3, 3 back hand

The other player would win the wager since both the other player and the player/banker have a back hand consisting of a pair of 3's. If the back hands of the other player and the player/banker are not identical, then the comparison process proceeds to step (l).

In step (n) the player/banker wins the wager of step (f) if the front hand of the other player is identical to (a "copy" of) the front hand of the player/banker, else proceeding to step (o). For example if the dealt and set cards were:

Other player: 8, 2, 8, 6→2, 6 front hand and 8, 8 back hand

Player/banker: 7, 7, 6, 2→2, 6 front hand and 7, 7 back hand

The player/banker would win the wager since both the other player and the player/banker have a front hand consisting of 2, 6. If the front hands of the other player and the player/banker are not identical, then the comparison process proceeds to step (m).

In step (o), the player/banker winning the wager of step (f) if (l) the front hand of both the other player and the player/banker have a least significant digit (LSD) of a numerical total equaling zero, or if (2) the back hand of both the other player and the player/banker have a least significant digit of a numerical total equaling zero, else proceeding to step (p).

For example if the dealt and set cards were:

Other player: A, 8, 7, 3→3, 7 front hand and A, 8 back hand

Player/banker: 10, 9, 8, 2→2, 8 front hand and 10, 9 back hand

The player/banker would win the wager since the numerical total of the front hands of both the other player and the player banker have a least significant digit of zero. In another example, if the dealt and set cards were:

Other player: 10, 10, 4, 9→4, 9 front hand and 10, 10 back hand

Player/banker: 8, 5, 3, 5→3, 8 front hand and 5, 5 back hand

The player/banker would win the wager since the numerical total of the back hands of both the other player and the player banker have a least significant digit of zero.

In step (p), the other player winning the wager of step (f) if the front hand of the other player ranks higher than the front hand of the player/banker and the back hand of the other player ranks higher than the back hand of the player/banker, else proceeding to step (q).

For example if the dealt and set cards were:

Other player: A, 2, 2, A→2, 2 front hand and A, A back hand

Player/banker: 9, 9, 9, 10→9, 10 front hand and 9, 9 back hand

The other player would win the wager since the front hand of the other player (2, 2) ranks higher than the front hand of the player/banker (9, 10), and the back hand of the other player (A, A) ranks higher than the back hand of the player/banker (9, 9). In another example, if the dealt and set cards were:

Other player: A, 2, 2, A→2, 2 front hand and A, A back hand

Player/banker: 3, 4, 4, 3→3, 3 front hand and 4, 4 back hand

The other player would not win the wager since the front hand of the player/banker (3, 3) ranks higher than the front hand of the other player (2, 2), even though the back hand of the other player (A, A) does rank higher than the back hand of the player/banker (4, 4).

In step (q), the player/banker winning the wager of step (f) if the front hand of the player/banker ranks higher than the front hand of the other and the back hand of the player/banker ranks higher than the back hand of the other player, else proceeding to step (r).

For example if the dealt and set cards were:

Other player: 2, 8, 4, 6→8, 6 front hand and 2, 4 back hand

Player/banker: 9, 7, 5, 5→7, 9 front hand and 5, 5 back hand

The player/banker would win the wager since the front hand of the player/banker (LSD of 6) ranks higher than the front hand of the other player (LSD of 4), and the back hand of the player/banker (5, 5) ranks higher than the back hand of the other player (2, 4). In another example, if the dealt and set cards were:

Other player: 9, 10, 7, 2→2, 7 front hand and 9, 10 back hand

Player/banker: 10, 5, 5, 8→8, 10 front hand and 5, 5 back hand

The player/banker would not win the wager since the front hand of the player/banker (LSD of 8) does not rank higher than the front hand of the other player (LSD of 9), even though the back hand of the player/banker (5, 5) does rank higher than the back hand of the other player (LSD of 9).

In step (r), if none of the conditions for winning the wager as set forth in steps (h) through (j), and (m) through (q) above are satisfied, neither the other player nor the player/banker wins the wager. That is, the round of play is a "push" with neither the other player nor the player/banker wins.

In step (s), if in step (g) any of the other players (not the player/banker) are dealt four of a kind (e.g. four 4's, four 8's, etc.) the other player having the four of a kind wins a jackpot. The amount of the jackpot is typically determined by the gaming establishment, and may be a fixed amount, or may be a progressive amount which increases as a function of how long it has been since a jackpot has been won. The jackpot is separate from and in addition to the winning of the wager placed in step (f).

In step (t) it is noted that steps (h) through (r) above must be performed in the exact alphabetical order indicated. It is important to note that in the game of the present invention, the sequence of testing for specific conditions is very important. That is, steps (h) through (r) must be performed in the alphabetical order indicated, least the outcome could vary. For example, if the dealt and set cards were:

Other player: 5, 5, 4, 9→4, 9 front hand and 5, 5 back hand

Player/banker: 8, 5, 3, 5→3, 8 front hand and 5, 5 back hand

In this example, the other player would win the wager because of step (m) wherein the other player wins the wager if the two back hands are identical. However, were step (o) performed before step (m), then the player/banker would win the wager since the LSD of both back hands is zero. As such, in the present invention the testing for conditions must be performed in the sequential order indicated (i. e. steps (h) through (r) in alphabetical order).

A round of play concludes with END.

The House Way

A preferred method of setting two card hands (step (k) ("house way") is offered below:

1. Always play the pair unless you have pair of 3's or 2's when the front hand is "2" or less. In this case, split the hand only when the front hand can be set 6 or higher. For example: 2,2,5,7, should be played as 5,2 in front and 7,2 in back.
2. Play the "9" on the back hand if possible.
3. If you cannot play a "9" on the back hand, then play the front hand as high as possible.
4. If the hand contains a joker, pick 2 of the 3 (non-joker) cards to make the best ranking combination in the one part, and the remaining card the joker to make the other part.

The embodiments of the invention described herein are exemplary and numerous modifications, variations, and rearrangements can be readily envisioned to achieve an equivalent result, all of which are intended to be embraced within the scope of the appended claims.

I claim:

1. A method of playing a wagering game, comprising:

(a) providing a modified deck of playing cards which includes a conventional deck of playing cards from which all face cards have been removed;

(b) defining a ranking of two card hands, wherein said ranking from highest to lowest is:

a pair of aces;
a pair of tens;
a pair of nines;
a pair of eights;
a pair of sevens;
a pair of sixes;
a pair of fives;
a pair of fours;
a pair of threes;
a pair of twos;
a least significant digit of a numerical total of two cards equaling nine;
a least significant digit of a numerical total of two cards equaling eight;
a least significant digit of a numerical total of two cards equaling seven;
a least significant digit of a numerical total of two cards equaling six;
a least significant digit of a numerical total of two cards equaling five;
a least significant digit of a numerical total of two cards equaling four;
a least significant digit of a numerical total of two cards equaling three;
a least significant digit of a numerical total of two cards equaling two;
a least significant digit of a numerical total of two cards equaling one; and,
a least significant digit of a numerical total of two cards equaling zero;

(c) providing a plurality of players;

(d) providing a dealer;

(e) selecting a player/banker from said plurality of players, said players who are not said player/banker being called other players;

(f) each of said other players placing a wager;

(g) said dealer dealing four cards from said modified deck to each of said players;

(h) said player winning said wager if one of said four cards dealt to said player is the ace of spades, else proceeding to step (i);

(i) said other player winning said wager if said four cards dealt to said other player are all of the same suit, else proceeding to step (j);

(k) said other player winning said wager if said four cards dealt to said other player are in consecutive numerical sequence, else proceeding to step (k);

(k) each said player setting his/her four cards into a two card front hand and a two card back hand;

(l) said player/banker sequentially comparing both front and back hands with each said other player;

(m) said other player winning said wager if said back hand of said other player is identical to said back hand of said player/banker, else proceeding to step (n);

(n) said player/banker winning said wager if said front hand of said other player is identical to said front hand of said player/banker, else proceeding to step (o);

(o) said player/banker winning said wager if (1) said front hand of both said other player and said player/banker have a least significant digit of a numerical total equaling zero, or if (2) said back hand of both said other player and said player/banker have a least significant digit of a numerical total equaling zero, else proceeding to step (p);

(p) said other player winning said wager if said front hand of said other player ranks higher than said front hand of said player/banker and said back hand of said other player ranks higher than said back hand of said player/banker, else proceeding to step (q);

(q) said player/banker winning said wager if said front hand of said player/banker ranks higher than said front hand of said other player and said back hand of said player/banker ranks higher than said back hand of said other player, else proceeding to step (r);

(r) neither said other player nor said player/banker winning said wager;

(s) if in step (g) said other player is dealt four of a kind, said other player winning a jackpot; and, wherein steps (h) through (r) above must be performed in the alphabetical order indicated.

* * * * *

UNITED STATES PATENT AND TRADEMARK OFFICE

CERTIFICATE OF CORRECTION

PATENT NO. : 6,779,795 B1
DATED : August 24, 2004
INVENTOR(S) : Johnny P. Le

It is certified that error appears in the above-identified patent and that said Letters Patent is hereby corrected as shown below:

Column 8,
Line 45, "(k)" should read -- ( j ) --

Signed and Sealed this

Thirtieth Day of November, 2004

JON W. DUDAS
*Director of the United States Patent and Trademark Office*